US006033021A

United States Patent [19]

Udo et al.

[11] Patent Number: 6,033,021

[45] Date of Patent: Mar. 7, 2000

[54] CHAIR HAVING AUTOMATIC ADJUSTABLE CYCLE SEAT

[76] Inventors: Hiroshi Udo, 3-7-5, Ushita-shinmachi Higashi Kiroshima 732; Akihiro Udo, Sampole Hiroko 801 8 F, 17-5 Osuga-chou, Minami-ku 732, both of Japan; Stephan Konz, 2834 Oregon, Manhattan, Kans. 66502

[21] Appl. No.: 09/165,818

[22] Filed: Oct. 2, 1998

[30] Foreign Application Priority Data

Nov. 20, 1997 [JP] Japan ..... 9-337770

[51] Int. Cl.[7] ..... A47C 1/024

[52] U.S. Cl. ..... 297/313; 297/217.3; 297/314; 297/330

[58] Field of Search ..... 297/217.1, 217.3, 297/311, 312, 313, 314, 330

[56] References Cited

U.S. PATENT DOCUMENTS

| | | | |
|---|---|---|---|
| 4,574,901 | 3/1986 | Joyner | 297/311 |
| 4,595,236 | 6/1986 | Rizzoli . | |
| 4,650,247 | 3/1987 | Berg et al. | 297/312 |
| 4,943,117 | 7/1990 | Brown . | |
| 5,113,851 | 5/1992 | Gamba | 297/330 |
| 5,261,723 | 11/1993 | Hosoe . | |
| 5,401,078 | 3/1995 | Riach . | |
| 5,588,704 | 12/1996 | Harza | 297/330 |
| 5,720,517 | 2/1998 | Prothro, Sr. . | |

*Primary Examiner*—Anthony D. Barfield
*Attorney, Agent, or Firm*—Hovey, Williams, Timmons & Collins

[57] ABSTRACT

A chair with an automatic seat which cyclically inclines is configured with a forward/backward cyclically inclining mechanism (8) which supports the seat (6) supplied separate from and independent of the backrest (2) so that the seat can be inclined forward and backward and driven mechanically to incline by continuously changing its inclining angle. The inclination direction of the seat can be automatically reversed within a specified angle range. In addition, the chair is equipped with a rightward/leftward cyclically inclining mechanism (13) which is rectangularly installed beneath the forward/backward cyclically mechanism (8) to support it along with seat 6 to allow and drive inclination in the rightward and leftward directions.

11 Claims, 3 Drawing Sheets

CHAIR HAVING AUTOMATIC ADJUSTABLE CYCLE SEAT

BACKGROUND OF THE INVENTION

Related Applications

The entire disclosure of Japanese Patent Application No. H09-337770 filed on Nov. 20, 1997, including specification, claims, drawings, and summary, are incorporated h ere in by reference in its entirety.

1. Field of the Invention

The present invention relates to a chair having an automatic cyclically inclining seat. The invention relates, in detail, to an automatic cycle seat having adjustable cycles and adjustable inclinations which is driven mechanically to incline cyclically forward and backward and/or side-to-side. The seat is designed to enhance sitting posture mobility by continuously changing the hip-joint angle (angle between trunk and thighs), lumbosacral angle (promontory angle), and trunkal lateral flexion angle. The seat of this invention further diminishes the strain of muscles surrounding the pelvis as well as the dorsolumbar muscles. Finally, pain in the breech and femoral region and swelling in the inferior limbs is mitigated by displacing contact with the seat.

2. Description of the Prior Art

Various attempts have been made to improve the design of office chairs and thus eliminate problems, such as lower back pain, which arise from sitting for long periods of time in certain positions. However, no chair has been designed which can prevent pain in the breech and femoral regions or swelling of the inferior limbs which occurs after prolonged sitting. Numerous problems arise from prolonged sitting. For example, prolonged sitting may induce chronic contractions in the posture-sustaining muscles (e.g., elector spinae, iliopsoas, and leg muscles), resulting in muscle fatigue and circulatory disorders manifested b y lower back pain and inferior limb swelling. A prolonged sitting position can also block the nutritive diffusion into interspinal disks, resulting in interspinal disk disorder and lower back pain. The interspinal disks have no blood vessels and are metabolized by nutrition diffused from peripheral vessels. This diffusion is prompted by the changes in the internal pressure of the interspinal disks which result from changing postures. Finally, a prolonged sitting position generates pressure on the regions in contact with the seat (i.e., ischial tuberosities and the back of the thighs), which induces circulatory disorders, resulting in pain in breech and thighs as well as swelling of the inferior limbs. Various chairs with manually-inclining seats have been utilized, including the rocking chair, which inclines as a whole, as well as chairs which allow the seat alone to be inclined.

The rocking chair has been used principally for rest. It is inclined by pressing one's feet against the floor or by swinging the upper body. The rocking chair cannot, however, be adapted to different operations. Moreover, it inclines only in the sagittal direction, not in the lateral direction. Its inclining ranges may be roughly adjusted by the feet or by upper body movement, but it cannot be minutely adjusted. A standard rocking chair's inclining rate is as high as sixteen (16) degrees per 1.6 seconds (inclining frequency is one cycle per 1.6 seconds or 0.63 Hz) when inclined with the upper body movement alone. Such a rapid inclination causes the line of vision to be rapidly displaced, resulting in eye strain and other difficulties in continuing office operations. When posture-locking operations are involved, its inclination rate is lowered since it is manually inclined. Furthermore, the rocker cannot be equipped with casters and has difficulties in rotating or displacements.

A seat-inclining chair comprises a seat on an inclining axis beneath its center, and is mobile within a range of between −5° (backward inclination) and +20° (forward inclination). The seat is inclined by displaced breech position or trunkal flexion. Although the inclining center, range, and rate are adjustable, each cannot be minutely adjusted. Furthermore, the inclination direction is solely sagittal, not lateral, and the inclining mechanism undermines the stable seat support and thus increases muscle contraction. Such a seat is difficult to operate. Since the seat-inclining chair is manually operated, its inclination rate is lowered when increased posture-locking operations are involved.

There are numerous problems and shortcomings in the above-mentioned conventional inclining chairs. These problems include the following:

1. Preferable Seat Inclinations Vary Depending Upon Individual Operations-When general office operations such as writing, reading, or retrieving documents are involved, a seat which allows the individual to incline forward is preferred. However, during typing or computer operations, a relatively backward inclined posture is preferred. This difference in inclining posture results from the varied positions of the objects being used (i.e., the computer screen, book, etc.) with respect to the individual. For example, for typing or computer operations in which the typing paper or screen is not even with the desk but rather inclined toward the operator, a slightly backward inclined posture is preferred. Preferable postures, therefore, differ depending upon the operations or arrangements of the objects. To resolve this problem, it is necessary to ensure that the inclination of the inclining center (motor center for cyclic inclination) can be freely adjusted in reference to the flat seat position. The seat position determined by a set inclining center is hereinafter referred to as the set inclination reference position.

2. Seat Inclination Increases as Time Elapses—During general office operations, forward seat inclination increases as sitting time increases. Typically, the anterior inclination of a seat will increase from 8.5 degrees to 9.2 degrees during 48 minutes of sitting. To resolve this problem, the inclining center must be able to continuously shift from its initial inclination in reference to the flat seat position (initial set inclination reference position) through another set inclination (final set inclination reference position) after a specified duration.

3. Inclining Range and Inclining Frequency Increase as Sitting Time Elapses—In general office operations, the seat inclining range and frequency are increased as sitting time elapses. Inclinations of two degrees or more will increase on the average from 40 per hour to 88 per hour for 48 minutes, while those of less than two degrees on the average will increase from 514 per hour to 621 per hour for the same duration. These increases result from the operator's attempt to avoid strained postures and to mitigate resulting fatigue. To resolve this problem, an office chair must be equipped with a mechanism which can increase the inclining range and frequency proportionate to elapsed time.

4. Highly Constraining Operations Reduce Inclining Range and Inclining Frequency—Keying leads to reduced inclining range and inclining frequency when compared to other typical office operations. This reduction is due to the intensely constrained posture specific to keying. To resolve this problem, the office chair must be provided with an automatic inclining mechanism which is driven mechanically rather than manually.

5. Frequency of Recrossing Legs Increases as Sitting Time Elapses—To avoid continued pressure in the ischial region, some individuals continually recross their legs during work requiring sitting. When legs are crossed, the overlying leg is relieved of the compression that was built up previously in the ischial tuberosities. To resolve this continued pressure, an office chair must recline in the rightward and leftward directions.

6. Inclining Rate—Greater inclining rates require the line of vision and posture to be quickly adjusted which may cause eye strain or other difficulties in the individual. To resolve this problem, the inclining rate must be adequately controlled.

7. Seat Stability—Seat stability is essential for office work requiring precision. Manually inclining chairs lack this stability. To overcome this problem, a chair must be equipped with an automatic inclining mechanism wherein the mechanism is driven mechanically rather than manually.

SUMMARY OF THE INVENTION

The present invention overcomes the problems in the art by providing a chair equipped with an automatic seat which inclines cyclically. The invention broadly concerns a forward and backward cyclically inclining mechanism which supports a seat that is separate from and independent of the chair's backrest. This allows the seat to be inclined both forward and backward and allows the operation to continuously change the seat's angle of inclination. This further allows the seat's inclination direction to be automatically reversed within a specified range of inclinations. In a preferred embodiment, the invention further comprises a rightward and leftward cyclically inclining mechanism which is placed rectangularly beneath the backward and forward cyclically inclining mechanism to support that mechanism along with the seat and further allowing the seat to incline to the right or to the left. The rightward and leftward cyclical inclining mechanism mechanically drives the seat to incline by continuously changing the inclination angle and by automatically reversing the inclination direction within a specified inclination range.

PREFERRED EMBODIMENTS OF THE INVENTION

Figure 1:
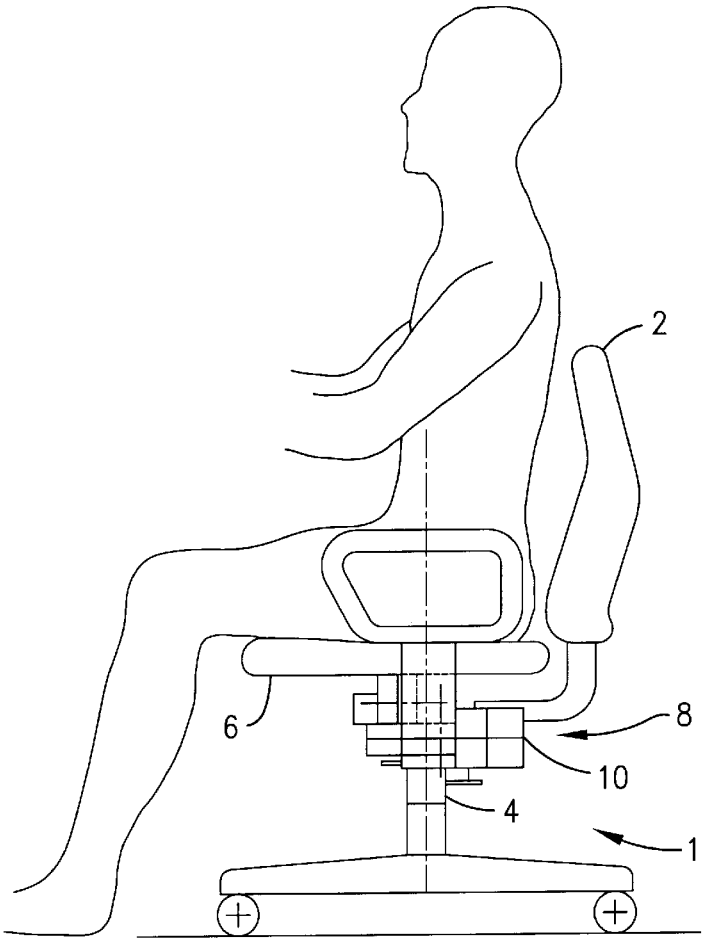
FIG. 1 is a side view of the chair with the automatic inclining seat of this invention.
Figure 2:
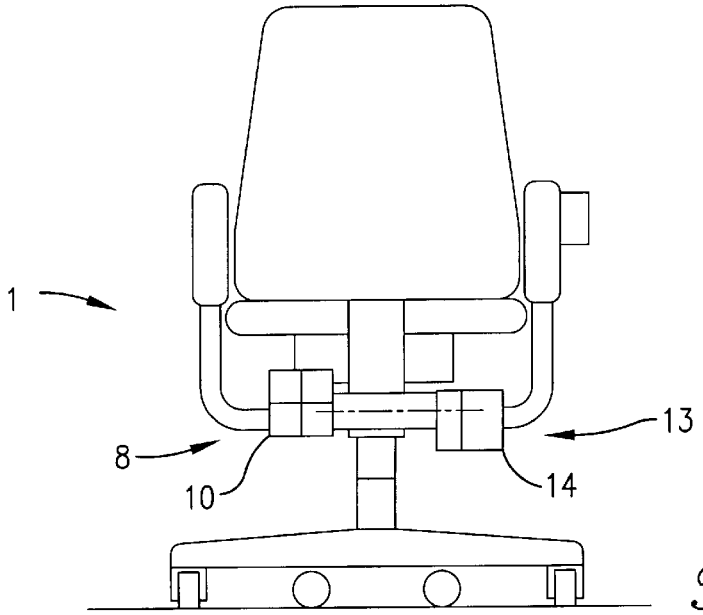
FIG. 2 is a rear view of the chair of FIG. 1.

The chair of this invention comprises a backrest fixed to the chair's base and a seat supported separately from and independent of the backrest, thus allowing the seat to incline above the chair leg without requiring movement of the backrest. The chair further includes a forward and backward inclining mechanism attached beneath the seat of the chair. This forward and backward inclining mechanism includes a forward and backward inclination driving device which mechanically drives the seat by continuously changing the angle of inclination of the seat. The forward and backward inclining mechanism further includes a forward and backward motion altering device which automatically reverses the inclination direction of the seat within a specified inclination range. The forward and backward inclination driving device includes a loop worm wheel mounted on the forward and backward inclining axis beneath the seat. The device supports and drives the worm axis by a motor via a decelerator. In a preferred embodiment of the invention, the chair further comprises a rightward and leftward cyclically inclining mechanism attached beneath the forward and backward inclining mechanism which is composed of a rightward and leftward inclination driving device. The rightward and leftward cyclically inclining mechanism allows the seat to incline to the right or to the left and to continuously change the angle of inclination of the seat. The preferred embodiment further includes a rightward and leftward motion altering device which automatically reverses the inclination direction within a specified inclination range.

The rightward and leftward inclination driving device is configured in a manner similar to the forward and backward inclination driving device. That is, it is provided with a loop worm wheel mounted on the rightward and leftward inclining axis of the forward and backward inclination driving device. The device further supports and drives the worm axis by a motor via a decelerator.

The forward and backward motion altering device is configured so that the rotary encoder attached to the end of the forward and backward inclining axis will control the rotation speed of the worm axis which functions as the output axis of the decelerator. The device will also instruct the worm axis to reverse its rotation direction when it detects an undesirable forward and backward inclination angle, thus maintaining the desired lower limit position.

The rightward and leftward motion altering device is likewise configured so that the rotary encoder attached to the end of the rightward and leftward inclining axis will cause the worm axis to reverse its rotation direction when the encoder detects an undesirable change in the rightward and leftward inclination angle. That is, the encoder, in conjunction with the worm axis, will maintain the inclination angle in the set lower limit position.

The forward and backward inclination angle of the seat is adjustable in a range of from about +20 degrees (forward) to about −5 degrees (backward) in reference to the axis of the seat when in its flat position. Similarly the rightward and leftward inclination angle of the seat is adjustable in a range of from about −5 degrees (rightward) to about +5 degrees (leftward) in reference to the flat seat position. The seat, therefore, is automatically inclinable in the sagittal and/or lateral directions. Simultaneously, the inclining center (the set inclination reference position), range, rate, and frequency are adjusted based upon specific operational characteristics and induced fatigue. The seat, which is not linked to the backrest, is inclined independent of the backrest to enhance the mobility of sitting postures by continuously changing the hip-joint angle, the lumbosacral angle, and the trunkal lateral flexion angle. It will be appreciated that because of these characteristics there is substantial mitigation of lower back pain, breech pain, and inferior limb swelling induced by prolonged sitting.

As illustrated by the figures, a chair 1 includes a backrest 2 which is fixed to a chair leg 4 separate from and independent of the seat 6, while the seat is supported above the chair leg 4 so that it can be cyclically inclined forward and backward with respect to the flat seat position. Additionally, the whole forward and backward inclining mechanism, including the seat 6 itself, is configured so that it can cyclically incline rightward and leftward. It is noted that the forward/backward and rightward/leftward inclinations are generated separately by their specific inclining mechanisms, as described below. Typically, their motions are combined, but it is possible adjust them individually (FIG. 1).

Figure 3:
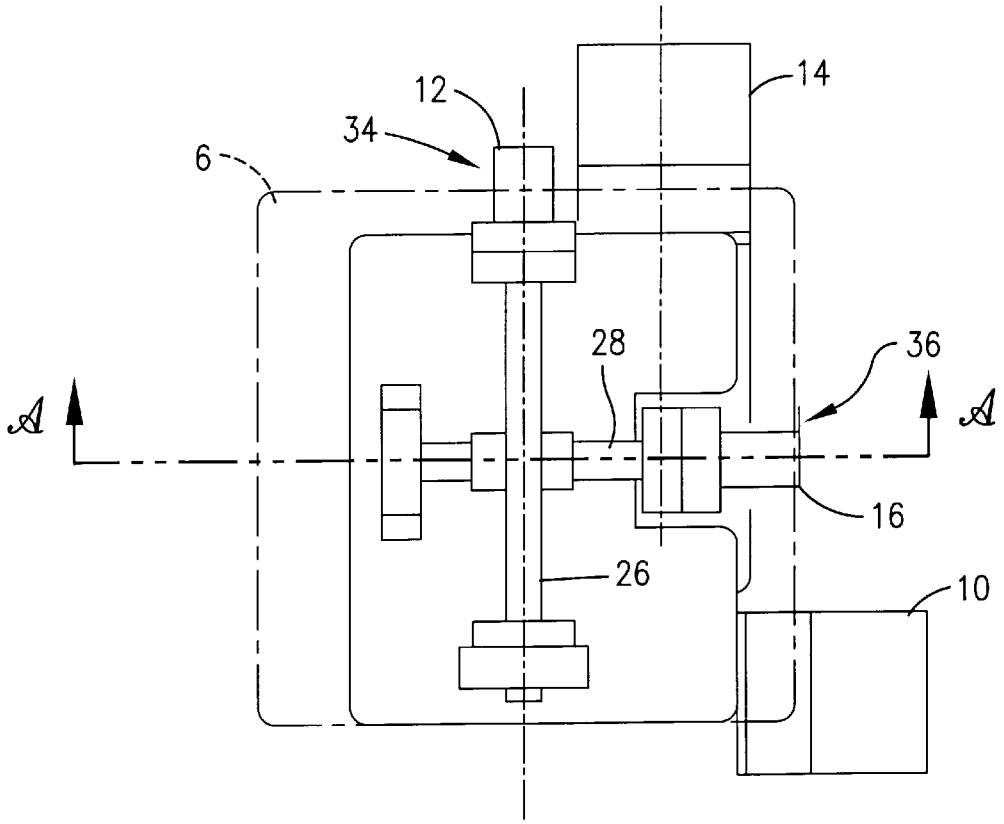
FIG. 3 is a bottom view of the chair of FIG. 1.

A forward/backward cyclically incline mechanism 8 is composed of a forward/backward inclination driving device 10 which is installed below the seat 6 to support seat 6 so that it can incline forward and backward in reference to its flat position. The forward/backward inclination driving device 10 mechanically drives the seat to incline by continuously changing its angle of inclination. A forward/backward motion altering device 12 automatically reverses the inclination direction of seat 6 within a specified angle range (see FIG. 3 and FIG. 4).

The rightward/leftward cyclically inclining mechanism 13 is composed of an inclination driving device 14 which is rectangularly installed beneath the forward/backward cyclically inclining mechanism 8 to support the whole mechanism 8 so that it can incline in the rightward and leftward directions with respect to the seat 6 when in its flat position. The driving device 14 mechanically drives the seat to incline by continuously changing its angle of inclination. A motion altering device 16 automatically reverses the rightward and leftward inclination direction of the above-mentioned mechanism 8 within a specified angle range (see FIG. 3 and FIG. 5).

Figure 4:
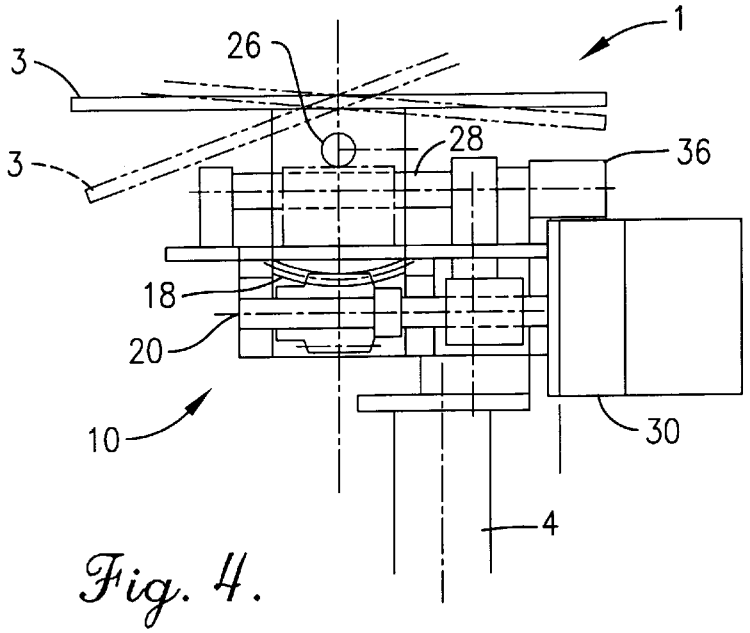
FIG. 4 depicts the inclining mechanisms of the chair of FIG. 1 when viewed from the side.
Figure 5:
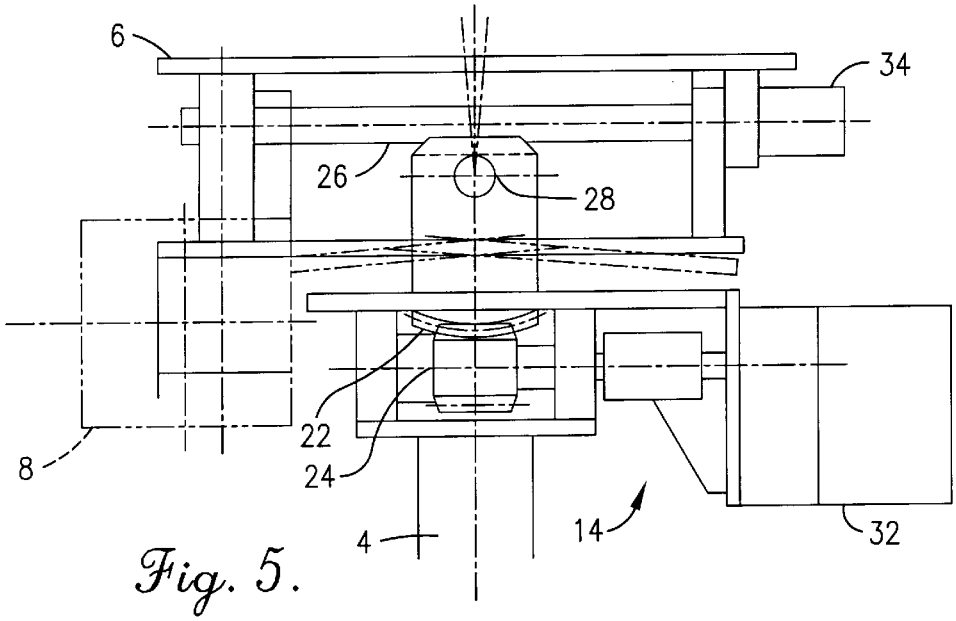
FIG. 5 illustrates the inclining mechanisms of the chair of FIG. 1.
Figure 6:
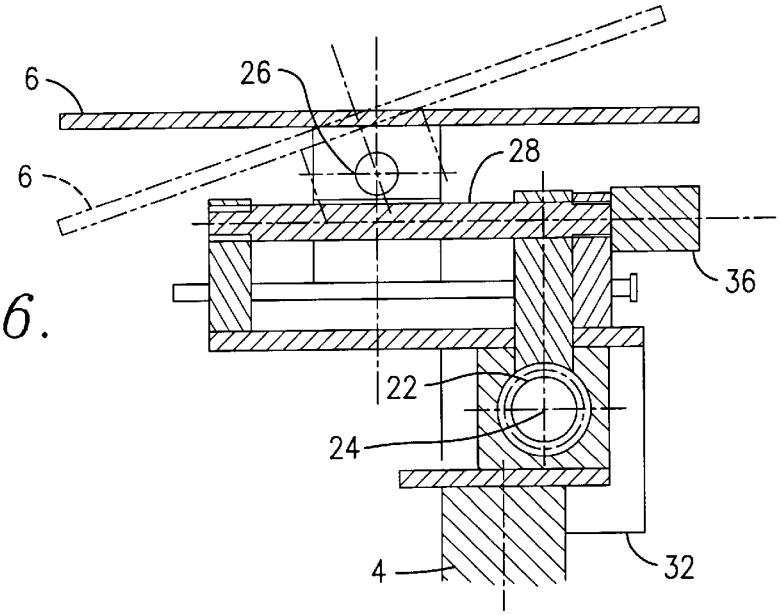
FIG. 6 is a cross-sectional view taken along lines A—A of FIG. 3.

The forward/backward and rightward/leftward cyclically inclining mechanisms use identical components for their respective inclination driving devices 10, 14 and motion altering devices 12, 16. The forward/backward and rightward/leftward inclination driving devices 10, 14 are mainly composed of worm wheel elements 18, 20, 22, 24 (FIGS. 4 and 5). The loop worm wheels 18, 22 are installed into the forward/backward inclining axis 26 beneath the seat 6 and the rightward/leftward inclining axis 28 of the forward/backward inclination driving device 10 respectively. Loop worm wheels 18, 22 thus support and drive the worm axes 20, 24 to engage with the above-mentioned worm wheels 18, 22 driven by motors via the decelerators 30, 32 (see FIG. 4, FIG. 5, and FIG. 6).

The forward/backward and rightward/leftward motion altering devices 12, 16 are designed to reverse the rotating direction of their respective worm axes when the encoders 34, 36, which are attached to their respective inclining axes 26, 28, detect the set lower limit position of the forward/backward or rightward/leftward inclination angle (the parameters to be controlled are the inclining angles for the axes 26, 28). The rotations speeds of the worm axes 20, 24 are controlled as are the output axes of the decelerators 30, 32 (see FIG. 3, FIG. 4, and FIG. 5).

The seat 6 is adjustable with respect to the forward and backward inclining angles in a range of from about 20 degrees forward to about 5 degrees backward in reference to the seat in its flat position. Furthermore, the seat 6 is adjustable with respect to the rightward and leftward inclining angles in a range from about 5 degrees rightward to about 5 degrees leftward in reference to the flat position of the whole forward/backward cyclically inclining mechanism 8. These angles are adjusted based upon the detected rotation angles of the inclination driving devices 10, 14. The rotation angles are detected by encoders 34, 36 which also control the motors for the respective driving devices. It will be appreciated that the inclining centers can be shifted throughout a period of time from the initial phase to the final phase of a cyclical inclination as programmed by their initial and final settings.

The inclining rate is adjustable in a range of a minimum of from about 20 degrees per five minutes to a maximum of about 20 degrees per five seconds. The inclining frequency is adjustable in a range of a minimum of from about one cycle per five minutes to a maximum of about one cycle per five seconds.

EXAMPLE

Figure 7:
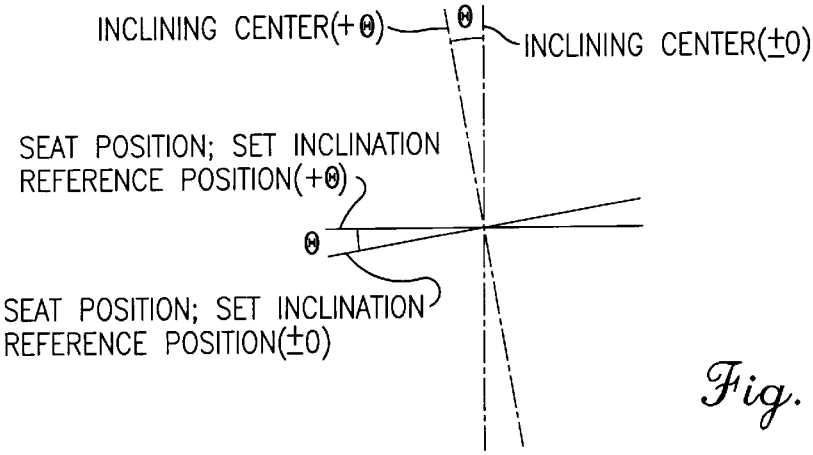
FIG. 7 illustrates the inclination angle of the seat with respect to the inclining center.

An example of a possible seat inclining setting for a chair used in general office work is described below. Referring to FIG. 7, the forward inclining angle of the seat in reference to its flat position is referred to as θ. The initial inclination center was set to θ=+8 degrees, with the range of the inclination angle set to θ=+5 to +11 degrees. In other words, the inclination stroke ranges from ±3 degrees with reference to the inclination center. The inclining frequency was set at 1 cycle/8 seconds (an inclining rate of 12 degrees/8 seconds). Additionally, the inclining center is set so that it will be linearly shifted to θ=+10 degrees with the inclining angle range proportionally shifted to θ=+6 to +14 degrees (i.e., the stroke ranges ±4 degrees with reference to the inclination center) during two hours. The inclining frequency is also set so that it will be linearly increased to 1 cycle/5 seconds (an inclination rate of 16 degrees/5 seconds) during the same period. These parameters are kept constant after this period.

It is noted that the control system (which is integrated into the controller box) for the driving system (inclination driving devices 10, 14) and the altering system (motion altering devices 12, 16) for the above-mentioned cyclically inclining mechanisms 8, 13 (the control system for which is integrated into the controller box) are not illustrated in the figures because they can be configured using any known conceptions.

The invention of this application produces the following effects:

1. The motor driven mechanisms allow the seat to incline automatically in the sagittal and/or lateral directions and to adapt its inclining center, range, and rate (therefore frequency) to specific operation characteristics and resulting fatigue.

2. The seat helps alleviate lower back pain, breech pain, inferior limb swelling, and eye strain by using these dynamic characteristics.

3. The seat alone is inclined, independent of and separate from the backrest, thus enhancing the mobility of sitting posture by continuously changing the hip-joint angle, lumbosacral angle, and the trunkal lateral flexion angle. The seat relaxes the continuous strain on muscles surrounding the pelvis and dorsolumbar muscles, and mitigates pain in the breech and femoral region as well as swelling in the inferior limbs by displacing contact with the seat. In addition, the resulting change in internal pressure on the spinal disks prompts nutrition diffusion.

4. When an operator assumes a normal posture on the chair, the seat, backrest, and floor each support about 65%, 10%, and 25% of his/her weight, respectively. When the sagittal inclination alternately biases the weight distribution from the seat contact region toward the backrest or the inferior limbs, compression on the breech and thighs is relieved, and blood circulation in the inferior limbs is promoted due to the alternate constriction/relaxation of inferior limbs (the muscle pumping effect).

5. The inclining rate can be set to less than 20 degrees/5 seconds in order to prevent the operator's line of vision and posture from rapidly changing. Such an inclination rate further eliminates eye strain or other difficulties in continuing operation.

We claim:

1. A chair comprising:

a base for supporting said chair on a supported surface;

a seat tiltably coupled with said base and being inclinable to a selected inclination, said seat being tiltable leftward and rightward;

a powered inclining mechanism coupled with said seat to change cyclically the inclination of said seat between predetermined inclination angles;

a sensing device oprable to sense said inclination and for producing an inclination output representative thereof; and a controller coupled with said powered inclining mechanism, said controller being operable to receive said inclination output and responsive thereto for operating said powered inclining mechanism.

2. The chair of claim 1, said sensing device including an encoder.

3. The chair of claim 1, said powered inclining mechanism including an electrical motor.

4. The chair of claim 3, said powered inclining mechanism including a tilt gear mechanically coupled with said seat, said motor including a drive shaft having a worm gear connected thereto engaging said tilt gear for rotation thereof upon operation of said motor.

5. The chair of claim 1, said seat further being tiltable forward and backward.

6. The chair of claim 1, said powered inclination mechanism being operable to change cyclically said inclination at a variable rate over time.

7. The chair of claim 1, said predetermined inclination angles being adjustable.

8. The chair of claim 1, further including a backrest coupled with said base, said backrest being separate from said seat.

9. The chair of claim 1, wherein the whole seat is tiltably coupled with said base.

10. A chair comprising:

a base for supporting said chair on a support surface;

a seat tiltably coupled with said base, said seat being inclinable to a selected inclination;

a powered inclining mechanism coupled with said seat to change cyclically the inclination of said seat between predetermined inclination angles, said powered inclining mechanism including an electrical motor and a tilt gear mechanically coupled with said seat, said motor including a drive shaft having a worm gear connected thereto engaging said tilt gear for rotation thereof upon operation of said motor;

a sensing device operable to sense said inclination and for producing an inclination output representative thereof; and a controller coupled with said powered inclining mechanism, said controller being operable to receive said inclination output and responsive thereto for operating said powered inclining mechanism.

11. A chair comprising:

a base for supporting said chair on a support surface;

a seat tiltably coupled with said base, said seat being tiltable forward and backward and leftward and rightward and being inclinable to a selected inclination; and a powered inclining mechanism coupled with said seat to change cyclically the inclination of said seat between predetermined inclination angles at a variable rate over time, said powered inclining mechanism including an electrical motor, an encoder to sense said inclination and for producing an inclination output representative thereof, a controller coupled with said motor, said controller being operable to receive said inclination output and responsive thereto for operating said motor, and a tilt gear mechanically coupled with said seat, said motor including a drive shaft having a worm gear connected thereto engaging said tilt gear for rotation thereof upon operation of said motor.

* * * * *